US012092341B2

(12) United States Patent
Bauer et al.

(10) Patent No.: US 12,092,341 B2
(45) Date of Patent: Sep. 17, 2024

(54) DOMESTIC APPLIANCE HAVING A PROXIMITY DETECTOR

(71) Applicant: BSH Hausgeräte GmbH, Munich (DE)

(72) Inventors: Hans-Jürgen Bauer, Traunstein (DE); Hoang Richter, Chieming (DE); Christoph Söllner, Munich (DE)

(73) Assignee: BSH Hausgeräte GmbH, Munich (DE)

( * ) Notice: Subject to any disclaimer, the term of this patent is extended or adjusted under 35 U.S.C. 154(b) by 414 days.

(21) Appl. No.: 17/611,191

(22) PCT Filed: Jun. 18, 2020

(86) PCT No.: PCT/EP2020/066967

§ 371 (c)(1),
(2) Date: Nov. 15, 2021

(87) PCT Pub. No.: WO2020/260130

PCT Pub. Date: Dec. 30, 2020

(65) Prior Publication Data

US 2022/0065460 A1 Mar. 3, 2022

(30) Foreign Application Priority Data

Jun. 24, 2019 (DE) ..... 10 2019 209 073.7

(51) Int. Cl.
*F24C 7/08* (2006.01)
*F24C 15/02* (2006.01)

(52) U.S. Cl.
CPC ..... *F24C 7/085* (2013.01); *F24C 15/024* (2013.01)

(58) Field of Classification Search
CPC ..... F24C 3/12; F24C 5/16
See application file for complete search history.

(56) References Cited

U.S. PATENT DOCUMENTS 5,951,900 A * 9/1999 Smrke ..... H05B 1/0266 219/431
2004/0240196 A1 12/2004 Wilsdorf
2013/0149947 A1* 6/2013 Bagwell ..... F24C 15/2007 454/49
2013/0320828 A1* 12/2013 Nitzsche ..... F24C 15/024 312/237

(Continued)

FOREIGN PATENT DOCUMENTS

DE 10122402 A1 11/2002
DE 102011010906 A1 8/2012

(Continued)

OTHER PUBLICATIONS

National Search Report DE 10 2019 209 073.7 dated Apr. 16, 2020.
International Search Report PCT/EP2020/066967 dated Aug. 19, 2020.

*Primary Examiner* — Ko-Wei Lin
(74) *Attorney, Agent, or Firm* — Michael B. Tschupp; Andre Pallapies; Brandon G. Braun

(57) ABSTRACT

A household appliance includes a treatment chamber closable by a door for treatment of items to be treated by a plurality of treatment processes, and a proximity detector designed to identify a presence of a person approaching the household appliance. The household appliance is designed to carry out an action in dependence on a state of a treatment process in progress, when identifying an approach of the person.

9 Claims, 2 Drawing Sheets

(56) References Cited

U.S. PATENT DOCUMENTS

| | | | | |
|---|---|---|---|---|
| 2016/0116891 | A1* | 4/2016 | Megger | G06F 3/0304 700/275 |
| 2017/0299194 | A1* | 10/2017 | Kamei | F24C 7/08 |
| 2017/0329358 | A1* | 11/2017 | Ferguson | H04L 12/1895 |
| 2018/0082564 | A1* | 3/2018 | Fang | G08B 21/0469 |
| 2019/0008006 | A1* | 1/2019 | Lee | H05B 6/6417 |
| 2019/0301745 | A1* | 10/2019 | Neal | F24C 15/10 |

FOREIGN PATENT DOCUMENTS

| | | | |
|---|---|---|---|
| DE | 102015117310 | A1 | 4/2017 |
| EP | 2990825 | A1 | 3/2016 |

* cited by examiner

DOMESTIC APPLIANCE HAVING A PROXIMITY DETECTOR

CROSS-REFERENCES TO RELATED APPLICATIONS

This application is the U.S. National Stage of International Application No. PCT/EP2020/066967, filed Jun. 18, 2020, which designated the United States and has been published as International Publication No. WO 2020/260130 A1 and which claims the priority of German Patent Application, Serial No. 10 2019 209 073.7, filed Jun. 24, 2019, pursuant to 35 U.S.C. 119(a)-(d).

The contents of International Application No. PCT/EP2020/066967 and German Patent Application, Serial No. 10 2019 209 073.7 are incorporated herein by reference in their entireties as if fully set forth herein.

BACKGROUND OF THE INVENTION

The invention relates to a household appliance, having a treatment chamber, which can be closed by a door, for treating items to be treated by means of a plurality of treatment processes and having at least one proximity detector for identifying the presence of a person approaching the household appliance. The invention also relates to a method for operating a household appliance, which has a treatment chamber for treating items to be treated by means of a plurality of treatment processes and a proximity detector for identifying the presence of a person approaching the household appliance, wherein at least one action is carried out by means of the method if it is identified that a person is approaching the household appliance during a treatment process in progress. The invention can be applied particularly advantageously to cooking appliances, in particular ovens.

DE 101 22 402 A1 discloses a method for securing a cooking appliance, in which a securing apparatus detects an object, in particular a person, approaching the cooking appliance, and if a first minimum distance of the object from the cooking appliance is identified as not being met, at least one first function of the cooking appliance, such as switching off a cleaning facility, switching off a heating facility, switching off a fan wheel, switching off the cooking appliance, switching on a vent, switching on a cooking chamber light and/or suchlike, is activated; as well as a cooking appliance carrying out this method.

DE 101 38 885 A1 discloses a household appliance with a door handle, which is embodied as a capacitance body, the capacitance of which can be changed by human contact in order to control a lighting facility as a function of the door handle capacitance.

DE 10 2011 010 906 A1 discloses a household appliance, in particular refrigerator and/or freezer, wherein the household appliance is embodied so that it comprises means, by means of which at least one function of the household appliance can be activated, wherein the household appliance has at least one detection unit or is connected at least at times to at least one detection unit, which is embodied such that by means of the detection unit it is possible to detect the presence of an object in the region of the household appliance and/or the movement of an object relative to the household appliance in a contactless manner, and that the detection unit is connected to the means so that the means trigger the function of the household appliance as a function of the information detected by the detection unit.

BRIEF SUMMARY OF THE INVENTION

The object of the present invention is to overcome the disadvantages of the prior art at least partially and in particular to provide a particularly user-friendly and reliable user guidance of a household appliance. One particular object of the present invention is to maintain a high treatment quality in a user-friendly manner.

This object is achieved according to the features of the independent claims. Advantageous embodiments form the subject matter of the dependent claims, the description and the drawings.

The object is achieved by a household appliance, having a treatment chamber, which can be closed in particular by a door, for treating items to be treated by means of a plurality of treatment processes and at least one proximity detector for identifying the presence of a person approaching the household appliance, wherein the household appliance is designed to carry out at least one action according to at least one state of a treatment process in progress if an approach is identified.

This household appliance has the advantage that the at least one action aimed at a user is carried out in a phased manner or as a function of a current at least one state and is not carried out or not carried out in the same way with each approach to the household appliance. It is therefore made possible to attune the at least one action in a targeted manner to the at least one state in terms of content. Consequently a reliability of a treatment process can be maintained during this state, e.g. by a possible disadvantageous operation of a user being prevented. Conversely it is possible to dispense with triggering this action if there is no need from the state herefor. This in turn increases user comfort because a user is then neither restricted in terms of operating the household appliance nor distracted as a result of unnecessary indications. The possibility of carrying out at least one action according to at least one state of a treatment process in progress, if an approach is identified, can therefore comprise that at least one action, attuned to at least one state of a treatment process in progress, is carried out or can be carried out if an approach is identified.

The fact that the household appliance has a treatment chamber for treating items to be treated by means of a plurality of treatment processes means that the household appliance is designed optionally to treat items to be treated which are located in the treatment chamber by means of a plurality of treatment processes or optionally to activate a plurality of treatment processes. The household appliance consequently comprises the possibility of carrying out one of several possible treatment processes at one time. A current treatment process can be selected by a user or operator, for instance. One or more process parameters may be selected or may have been selected in relation to a treatment process, namely by the user and/or automatically, e.g. within the scope of an automatic program, electronic cookbook etc.

In one embodiment, the household appliance is a cooking appliance and is designed to carry out at least one action according to at least one state of a cleaning or food treatment process in progress if an approach is identified. The cooking appliance can be e.g. an oven, a hob, a microwave appliance, a steam treatment appliance etc. or any other combination thereof, e.g. an oven or a cooker with microwave and/or steam treatment function. In the case of a cooking appliance, the treatment chamber can be referred to as a cooking chamber and the item to be treated can be a food to be cooked.

However, the household appliance is not restricted hereto and can also be a dishwasher or a laundry care appliance such as a washing machine, a tumble dryer or a washer dryer. In general, the household appliance can be a large household appliance, but also a small household appliance, in particular an electrically operated kitchen appliance. In the case of a laundry treatment appliance, the treatment chamber can be referred to as a laundry drum and the item to be treated as laundry.

In general, a treatment process can be a process or course of action for treating an item to be treated disposed in the treatment chamber and/or a process for treating the treatment chamber as such (e.g. a cleaning process, a decalcification process etc.).

The at least one proximity detector can be embodied and arranged in particular to detect a distance from the household appliance not being met and/or to detect contact with the household appliance in a contactless manner. The type of proximity detector is not restricted and can, in the case of a contactless proximity detector, include e.g. a visual camera, an IR sensor (in particular a passive IR sensor (MR sensor), including an IR camera), a light barrier, a radar sensor, an ultrasound sensor, a LiDAR etc. For instance, the visual camera can identify the presence of a person, including a part thereof, for instance a hand, approaching by means of image evaluation. A touch sensor can be for instance a capacitive, inductive, resistive etc. touch sensor. In one development, the at least one proximity detector is designed or controlled so that it enables or carries out a permanent or continuous monitoring, in particular in a spatial region in front of the door of the household appliance.

The at least one proximity detector can be arranged at any point on the household appliance, e.g. in a control panel, a door handle etc.

In one particularly simple embodiment, the identification of the presence of a person approaching can correspond to the identification of the presence of an object approaching the household appliance. Depending on the desired identification accuracy and/or a computing power available, the identification may also involve a decision as to whether the object is a living person, for instance on the basis of a size of the object, a shape of the object, a movement of the object and/or a thermal radiation of the object. In one development, the identification as to whether a human person is approaching the household appliance can be performed by discriminating against other objects such as non-living objects, animals etc. It is then also possible, e.g. on the basis of size information and/or face recognition, to distinguish between adults and children, authorized and unauthorized people etc., e.g. by means of facial recognition. Further influencing variables can comprise an identification of a user's intention to interact with the household appliance and/or temporary influencing variables (e.g. whether an object/person has already been located in the vicinity of the household appliance for longer than a predetermined period of time). Such person identification mechanisms and scenarios are basically known and are therefore not looked at in more depth in the following.

The evaluation of the sensor data, in particular for person recognition, can be carried out by the household appliance itself, which advantageously facilitates or enables an autonomous operation. The household appliance to this end has in particular corresponding evaluation means such as a suitably designed data processing facility, e.g. comprising a processor and a data memory.

However, person recognition can also be carried out in part or entirely by means of an external entity connected via data technology to the household appliance, such as a network server, a cloud computer etc. This is advantageous in that the household appliance can be embodied in a particularly simple and cost-effective manner. For this purpose it requires in particular a data interface for connection to the external entity, e.g. by way of the Internet. The data interface can be a wireless data interface such as a WLAN module, a Bluetooth module etc. and/or a wired data interface such as an Ethernet module etc.

The state can comprise one or more of the following states or types of state:

- a specific treatment process, e.g. a specific cooking process, currently being carried out;
- a specific process step of the treatment process, e.g. of a specifically controlled heating section, which is carried out after a reheating section and/or before a keep-warm section, for instance, currently being carried out;
- at least one parameter of the treatment chamber falling within a predetermined value band or above or below a predetermined threshold value, e.g. a cooking chamber temperature exceeding a predetermined threshold value;
- at least one parameter of the items to be treated falling within a predetermined value band or above or below a predetermined threshold value, e.g. a surface temperature or a height of the food to be cooked exceeding a predetermined threshold value;
- a type of item to be treated;
- etc.

but is not limited hereto. The state can comprise in general e.g. a state of an atmosphere of the treatment chamber such as a current temperature level or a current humidity and/or a state of an item to be treated such as its surface temperature, core temperature, shape, size and/or degree of browning etc. This is cited in more detail again below.

In one development, the fact that the at least one action can be or is carried out on the basis of a state of a treatment process in progress means that a treatment process is currently running and the household appliance is not simply just switched on.

Carrying out the at least one action in a state-dependent manner upon approach means in particular that different actions can be carried out for at least two different states. However, this does not exclude the same actions from being carried out for at least two different states. However, it does not include in particular the same actions being triggered for all states or the same actions always being triggered for a switched-on appliance.

In one embodiment, the at least one action involves outputting at least one indication to a user. The advantage is achieved in that a user can be referred to a possible operation which would have disadvantages for the treatment of the items to be treated. This takes into account that the same possible user operation (e.g. an opening of a door closing a cooking chamber) can have different consequences (e.g. a cooking result is affected more or less greatly as a result also of briefly opening a door) as a function of the state (e.g. the temperature of the cooking chamber, the type of items to be cooked etc.).

In one embodiment, a type of indication is dependent upon the at least one state of the treatment process in progress. As a result, a user can be referred particularly effectively to a consequence of his possible operation or use of the household appliance in its current state.

In general the at least one indication can comprise a visual indication and/or acoustic indication, for instance a color signal, a flashing signal, an output of a symbol and/or a text on a monitor, a tone signal and/or a voice message. To this end the household appliance can at least one display facility such as one or more lamps (e.g. LEDs), segment displays, monitors etc. and/or at least one loudspeaker, buzzer, vibration facility etc.

The indication can be an indication with respect to the behavior of the user on the device. The indication can therefore comprise at least one warning message not currently to open the door. The indication can also comprise an explanation in text form, e.g. "Caution! Hot cooking chamber" or "Opening the door can interfere with the cooking result".

Alternatively or in addition the indication can be an operating instruction or an instruction for use. This is advantageous in that an improved treatment result can be achieved. For instance, a cooking appliance can comprise an indication such as "Prick the cake in order to check the consistency of the batter" etc. as a function of the at least one state of a treatment process in progress.

Alternatively or in addition the indication can be a further indication such as an energy-saving indication, which suggests energy-saving behavior to a user, e.g. "It is better not to open doors to save energy" etc.

An additional or alternative development is that the household appliance has a locking mechanism which can be actuated on the appliance side and the action comprises a locking of the door. The locking prevents the customer from being able to open the doors in the closed state. This development means that in specific states the door is only locked if a user is approaching, and otherwise is or remains unlocked. In one particularly advantageous development, in at least one state the door is locked when a user is approaching and an indication of this is output to the user. The advantage is thus achieved that a user can be kept from unsuccessfully opening the door as a result of the indication. This in turn reduces a frustration of the user and moreover reduces a mechanical load on the door and/or the locking mechanism. This advantage of outputting an indication of a locked door is also achieved if the door has been locked independently of the identification of the presence of a person approaching.

In one, possibly also state-independent, development, if a user is identified as approaching a locked door, a recommendation on possible operations is output which instructs a user in terms of how the locked door can be opened. A locked door may therefore be necessary for a cleaning program with chemicals, for instance, which the user is however to be able to open in the event of an emergency, in order to put out a fire or prevent other damage for instance. Here the recommendation on possible operations could comprise, for instance, that the handle must be touched or actuated by the user with both hands for at least 5 seconds, before the locking is released at the user's risk.

In one development, the action, in particular an output of an indication, is dependent upon an identified person or type of identified person, e.g. as a function of whether the person is a child or an adult. For instance, an indication can be output when a child is identified, but not when an adult is identified. Another indication can also be output if the presence of a child approaching has been identified, etc. Therefore if a child is approaching, a particularly clear, e.g. particularly loud and/or brightly lit indication can be output. This development can also be applied to individual persons with a personalized person identification. Therefore contents of indications, the output and/or the visual and/or acoustic representation thereof can be adjusted to individual persons.

In one embodiment, the identification of the presence of a person approaching is an identification of the presence of a person approaching (including touching) a door handle. The advantage is thus achieved that an action can automatically be triggered by the appliance, which warns a user of a potentially particularly disadvantageous operation, namely the opening of the door. The appliance can identify if the user is attempting to open the door. In one development, at least one a touch sensor such as a capacitive, inductive, resistive, etc. touch sensor is integrated into the door handle. Alternatively or in addition, a proximity sensor which operates in a contactless manner, such as a PIR sensor, ultrasound sensor, laser barrier, laser scanning module etc., can be integrated into the handle. However, in this embodiment too, the proximity detector does not need to be present in the door handle, but can be arranged at another point on the household appliance. For instance, the approach to a door handle can be identified in that a camera is integrated into a control panel and a hand approaching the door is identified by image evaluation. The door handle can be embodied as a door bar, molded recess etc.

In one embodiment, the household appliance is designed to carry out a number of treatment processes of a different type (e.g. different cooking programs or operating modes, washing programs, rinsing programs etc.) and the household appliance is designed to carry out at least one action according to the type of treatment process currently being carried out, if an approach is identified. This is advantageous in that the at least one action can be adjusted to an activation of a specific treatment process. For instance, in the case that a cooking process with a low cooking chamber temperature such as a simmering process or gentle cooking process is taking place, no indication can be output if an approach is identified, whereas in the case that a cooking process with a high cooking chamber temperature such as a roasting or grilling process is taking place on a cooking appliance, an indication can be output, e.g. in terms of the risk of hot air escaping when a cooking chamber door is opened.

In one embodiment, the treatment process has a number of process sections of a different type, and the household appliance is designed to carry out at least one action according to the type of process section currently being carried out, if an approach is identified. This is advantageous in that the at least one action can be adjusted to an activation of a specific process sections treatment process. Different process sections can be functionally different sections, i.e. sections or phases which are used for a different function or purpose.

In the case of a cooking appliance, the sections can comprise, for instance:

- a heat-up section,
- a control section, in particular for controlling a cooking chamber temperature, especially to a target temperature which is predetermined on the user side or by means of a cooking program,
- a keep-warm section,
- a vaporization section,
- etc.

Different sections can also comprise a number of different control sections, e.g. with a noticeably different cooking chamber target temperature. Therefore for roasting purposes a section can be a roasting section with a high cooking chamber target temperature, followed by a low cooking section with a noticeably lower cooking chamber target temperature. Opening a door during the roasting section would result in a significant drop in temperature, which can noticeably affect a cooking result. In addition, very hot air would then escape from the cooking chamber. These disadvantages would be noticeably less or practically not disadvantageous during the simmering phase. Finally, an indication of the consequences of a door opening could be output during the roasting section, while no indication or only a treatment indication is output when an approach is identified during the simmering section. Different sections can also comprise a number of functionally identical control sections, which are however separated from one another by means of other sections.

In the case of a dishwasher, the sections can comprise, for instance, washing phases, drying phases, rinse-aid phases etc. An indication can be output e.g. by a dishwasher if the presence of a person approaching a door handle is identified during a washing phase, since, when the door is opened, water can spray out of the appliance (for instance an indication of the type "Caution! spraying water"), whereas during a drying phase another indication (e.g. of the type "Caution! hot, damp air") or also no indication is output. In the case of a laundry care appliance, the sections can comprise, for instance, washing phases, pump-off phases, spinning phases, drying phases etc.

In one embodiment, the household appliance has at least one treatment chamber sensor and is designed to carry out at least one action according to a current use of at least one treatment chamber sensor if an approach is identified. As a result, the advantage is achieved that specific treatment processes or sections thereof, during which the treatment chamber sensor is used, can be protected especially by means of indications and/or other actions. This applies in particular for sections in which an undisturbed cooking chamber atmosphere monitored by the treatment chamber sensor is important. For instance, an oven can be designed to monitor a baking process on the basis of an oxygen concentration in the cooking chamber ("sensor baking"). To this end, an oxygen sensor such as a Lambda probe can measure the oxygen concentration in the closed and sealed cooking chamber. A data processing facility of the cooking appliance, e.g. its central control unit, can determine the state of the food to be cooked or its cooking progress from the course of the oxygen concentration and determine the end of the baking program to be selected for a desired cooking result dynamically at runtime for the food to be cooked. A prerequisite for a reliability of this function is that the cooking chamber remains closed, so that the oxygen concentration changes exclusively on account of the baking process and is not falsified as a result of the atmospheric oxygen penetrating from the outside. The action when a person approaching the oven, in particular its door handle, is identified, can then comprise for instance an indication of the type "Caution! Sensor baking will end if the door is opened!". This indication is therefore used to warn an approaching person to continue a specific operation which would have a negative effect on the cooking result.

In one development, the household appliance has a number of sensors of a different type (a cooking appliance, for instance, has a temperature sensor for sensing a cooking chamber temperature, a core temperature sensor, an oxygen sensor etc.) and is designed to carry out at least one action according to a current use of at least one type of the at least one sensor (e.g. the oxygen sensor) if an approach is identified.

In one embodiment, the household appliance is designed to carry out at least one action according to a type of item to be treated which is treated during the treatment process in progress if an approach is identified. Therefore items to be treated which respond particularly sensitively to user operations can be protected against intervention from a user, in order to maintain an advantageous treatment result. For instance, at least one indication can be output to a user of an oven if the food to be cooked requires as constant conditions as possible in the cooking chamber, for instance when allowing dough to prove. The proving may be considered to have failed if the door is opened, since the dough would then collapse. The fact that a specific item to be treated is present may be known to the household appliance in that a user has entered this information into the appliance or has selected the same on the appliance and/or has selected a corresponding automatic program. In one development, it does not depend on whether the item to be treated is actually in the treatment chamber, but instead that a treatment process provided to treat this item to be treated is activated. The embodiment can therefore also be worded so that the household appliance is designed to carry out at least one action, if an approach is identified during a treatment process in progress, which is provided to treat a specific type of items to be treated.

The object is also achieved by a method for operating a household appliance, which has a treatment chamber for treating an item to be treated by means of a plurality of treatment processes and a proximity detector for identifying a person approaching the household appliance, wherein the method is used to carry out at least one action if it is identified that a person is approaching the household appliance during a treatment process in progress and a predetermined state of the treatment process in progress is simultaneously present. The method can be embodied similarly to the household appliance and has the same advantages.

BRIEF DESCRIPTION OF THE DRAWINGS

The afore-described properties, features and advantages of this invention and the manner in which these are achieved will become clearer and more intelligible in conjunction with the following schematic description of an exemplary embodiment which is explained in more detail in conjunction with the drawings.

DETAILED DESCRIPTION OF EXEMPLARY EMBODIMENTS OF THE PRESENT INVENTION

Figure 1:
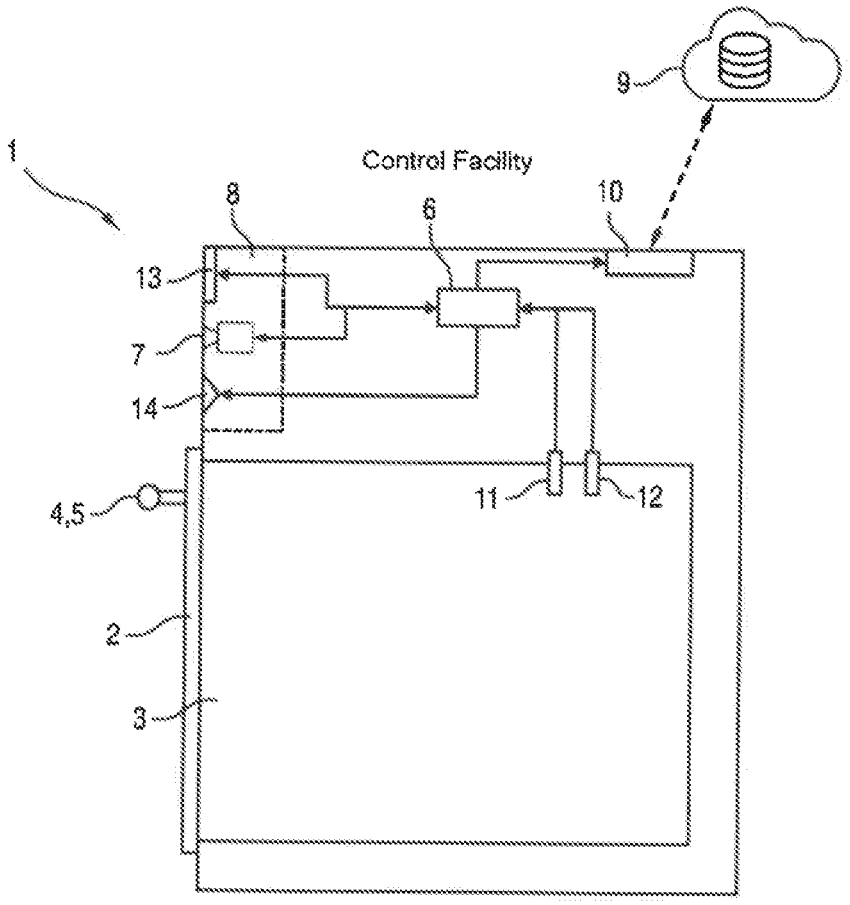
FIG. 1 shows an outline of an inventive household appliance in the form of an oven.

FIG. 1 shows an outline of a household cooking appliance in the form of an oven 1. The oven 1 has a cooking chamber 3 which can be closed by means of a front cooking appliance door 2. The door 2 has a door handle 4, into which at least one proximity detector is integrated in the form of a capacitive touch sensor 5. The at least one touch sensor 5 is connected to a data processing facility e.g. in the form of a central control facility 6. The control facility 6 can evaluate the sensor data of the at least one touch sensor 5 and as a result identify contact with the door handle 4 and subsequently identify a person approaching the oven 1, in particular the door handle 4. Alternatively or in addition the presence of a person approaching can be identified by means of a proximity detector in the form of a visual camera and/or IR camera 7, which is integrated into a control panel 8 of the oven 1, for instance.

The evaluation of the sensor data (possibly including images) to identify the presence of a person approaching the door handle 4 can therefore be carried out by means of the control facility 6. Alternatively or in addition, the identification can be carried out by an entity 9 outside of the appliance which is coupled to the oven 1 via data technology, such as a cloud computer or a network server, inter alia. In order to communicate with the entity 9 outside of the appliance, the oven can have a communication module 10, e.g. a WLAN module, an Ethernet module etc.

The control facility 6 is further designed to control the oven, for instance in order to carry out a number of treatment processes such as different modes of operation (e.g. grilling mode of operation, bottom heat mode of operation etc.), different automatic programs (e.g. programs for roasting, baking bread etc.). To this end, the control facility 6 can control corresponding functional units, such as heating elements, a microwave generator (if present), an evaporator (if present) etc. In order to carry out the treatment processes, including control programs, the control facility 6 is equipped with one or more cooking chamber sensors, such as here a temperature sensor 11 and an oxygen concentration sensor 12.

The oven 1 is moreover designed to carry out at least one action according to at least one state of a treatment process in progress if the presence of a person approaching is identified. The action can comprise outputting an indication, dependent on the current state, to a user. The indication can comprise an outputting of a visual indication (e.g. text) on a monitor 13, a generation of an acoustic indication by means of a loudspeaker 14, a color change in lamps, such as LEDs etc.

Figure 2:
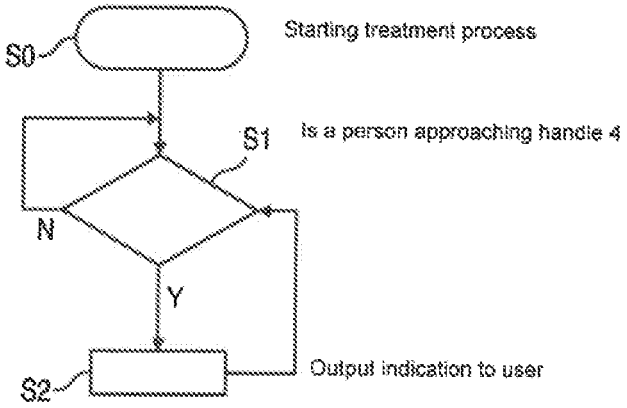
FIG. 2 shows an exemplary embodiment of a flow chart of an inventive method, which can run on the oven shown in FIG. 1.

FIG. 2 shows a flow chart for operating the oven 1 according to a first possible exemplary embodiment. Here only that part of a treatment process which deals with the state-dependent execution of an action if the presence of a person approaching the door handle 4 is identified is described in more detail.

In a step S0, the treatment process is started.

In a step S1, a check is carried out to determine whether a person is approaching the door handle 4. If this is not the case ("N"), the query is carried out again. In particular the query can take place at regular intervals upon identification of the approach, in particular continuously and virtually continuously, e.g. every second.

If, conversely, the presence of a person approaching the door handle 4 is identified ("Y"), in a step S2 the state of the treatment process is queried or used in order to output an indication attuned thereto. The indication is output for as long as the person is approaching or has approached the door handle 4, and/or as the cooking chamber door 2 has not been opened.

At the end of the treatment process, when a predetermined time is reached after the treatment process has ended or when the oven 1 is switched off, the method is also ended.

For instance, the following scenarios may occur:

In a first scenario, an automatic program for roasting meat has been started in step S0, which has a roasting phase with a high cooking chamber temperature and a subsequent simmering phase with a low cooking chamber temperature. If an approach is identified in step S1, while the roasting section is active, at least one notification is output to a user in step S2, e.g. as the text "Caution: very hot cooking chamber" or the like in the monitor 13, by outputting a warning tone or a spoken text using the loudspeaker 14 and/or by illuminants changing color, flashing etc. If, conversely, in step S1 an approach is identified while the simmering phase is active, none or at least another indication is output to a user.

In a second scenario, in step S0, a treatment process has been started, which comprises a proving of yeast, namely during the entire treatment process or during a section thereof. The treatment process is then used to bake yeast cakes, for instance. If an approach is identified in step S1 while the yeast is being allowed to prove, in step S2 at least one indication is output to a user, e.g. as a text "Caution! Yeast cakes will collapse", or the like in the monitor 13, by outputting a warning tone or a spoken text using the loudspeaker 14 and/or by illuminants changing color, flashing etc.

In a third scenario, in step S0, a treatment process has been started, which comprises a sensor baking using the oxygen concentration sensor 12, and namely during the entire treatment process or during a section thereof. If an approach is identified in step S1 while the sensor baking is active, at least one indication is output to a user in step S2, e.g. as the text "Caution! sensor baking will be terminated if the door is opened" or the like in the monitor 13, by outputting a warning tone or a spoken text by means of the loudspeaker 14 and/or by illuminants changing color, flashing etc.

In a fourth scenario, the oven 1 is an oven capable of pyrolysis, wherein a pyrolytic self-cleaning process has been started in step S0. The cooking chamber door 2 is also locked here. If an approach is identified in step S1 while the pyrolysis is active, in step S2 at least one indication is output to a user, e.g. as the text "Caution: self-cleaning in operation. For safety reasons the door is locked" or the like in the monitor 13, by outputting a warning tone or a spoken text by means of the loudspeaker 14 and/or by illuminants changing color, flashing etc.

The present invention is naturally not restricted to the exemplary embodiment shown.

The invention claimed is:

1. A household appliance, comprising:

a treatment chamber closeable by a door for treatment of items to be treated by a plurality of treatment processes; and a proximity detector designed to identify a presence of a person approaching the household appliance, wherein the household appliance is designed to carry out an action according to a state of a treatment process of the plurality of treatment processes in progress, when identifying an approach of the person.

2. The household appliance of claim 1, wherein each of the plurality of treatment processes are of a different type, with the household appliance being designed to carry out the action according to the type of treatment process currently being carried out, when the approach is identified.

3. The household appliance of claim 1, further comprising a number of treatment chamber sensors each being of a different type, said household appliance being designed to carry out the action in according to a current use of a type of at least one of the treatment chamber sensors, when the approach is identified.

4. The household appliance of claim 1, wherein the household appliance is designed to carry out the action according to a type of the items to be treated which is being treated during the treatment process of the plurality of treatment processes in progress, when the approach is identified.

5. The household appliance of claim 1, wherein the action comprises outputting an indication to a user.

6. The household appliance of claim 5, wherein the type of indication is dependent upon the state of the treatment process of the plurality of treatment processes in progress.

7. The household appliance of claim 5, wherein the identification of the approach is an identification of an approach to a door handle.

8. The household appliance of claim 1, constructed in the form of a cooking appliance, with the treatment process being a cleaning or food treatment process, said housing appliance being designed to carry out the action according to a state of the cleaning or food treatment process in progress, when the approach is identified.

9. A method for operating a household appliance, said method comprising:

identifying with a proximity detector a presence of a person approaching the household appliance; and carrying out an action when identifying the person approaching the household appliance during a treatment process of a plurality of treatment processes in progress for treatment of an item to be treated in a treatment chamber of the household appliance and when a predetermined state of the treatment process in progress is simultaneously present.

* * * * *